United States Patent [19]

Brenner

[11] 4,252,454

[45] Feb. 24, 1981

[54] CLEANING DEVICE

[76] Inventor: Robert W. Brenner, 7921 Mentor Ave., Mentor, Ohio 44060

[21] Appl. No.: 17,173

[22] Filed: Mar. 2, 1979

[51] Int. Cl.[3] ..... B43K 29/00; A47L 13/26

[52] U.S. Cl. ..... 401/37; 15/210 R; 401/195

[58] Field of Search ..... 15/210 A, 210 R, 244 R, 15/244 C, 105; 401/7, 9, 37, 38, 39, 22, 23, 196, 204, 205, 206, 195

[56] References Cited

U.S. PATENT DOCUMENTS

| | | | |
|---|---|---|---|
| 1,060,524 | 4/1913 | Wolfe | 401/37 |
| 1,410,620 | 3/1922 | Strieff | 401/203 |
| 2,501,289 | 3/1950 | Orndorff | 401/204 |
| 2,607,513 | 8/1952 | Lawson | 401/280 |
| 2,814,060 | 11/1957 | Aschenbach | 401/39 |
| 2,880,443 | 4/1959 | LeFebvre | 15/244 |
| 3,432,245 | 3/1969 | Hudson | 401/184 |
| 4,078,865 | 3/1978 | Moser | 401/23 |

FOREIGN PATENT DOCUMENTS

| | | | |
|---|---|---|---|
| 2406389 | 8/1975 | Fed. Rep. of Germany | 401/24 |

*Primary Examiner*—Robert W. Michell
*Assistant Examiner*—J. L. Kruter
*Attorney, Agent, or Firm*—Frank B. Robb

[57] ABSTRACT

There is disclosed a cleaning device particularly arranged to have a cleaning element and drying instrumentalities of substantially identical form and selected foam material arranged to conform to particular configurations which will enable application of cleaning material to a surface and likewise dry such surface thereafter by manipulation of the device, supply of cleaning material being provided by a container integral therewith, and simple construction being an essential aspect.

5 Claims, 4 Drawing Figures

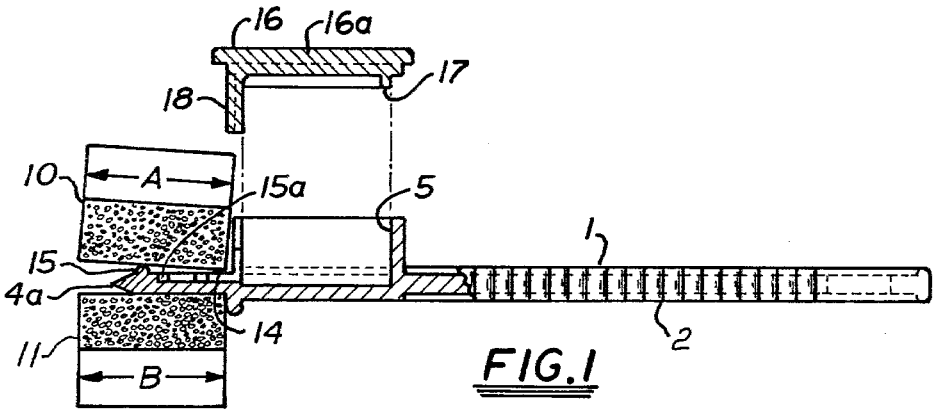
FIG. 1
FIG. 4
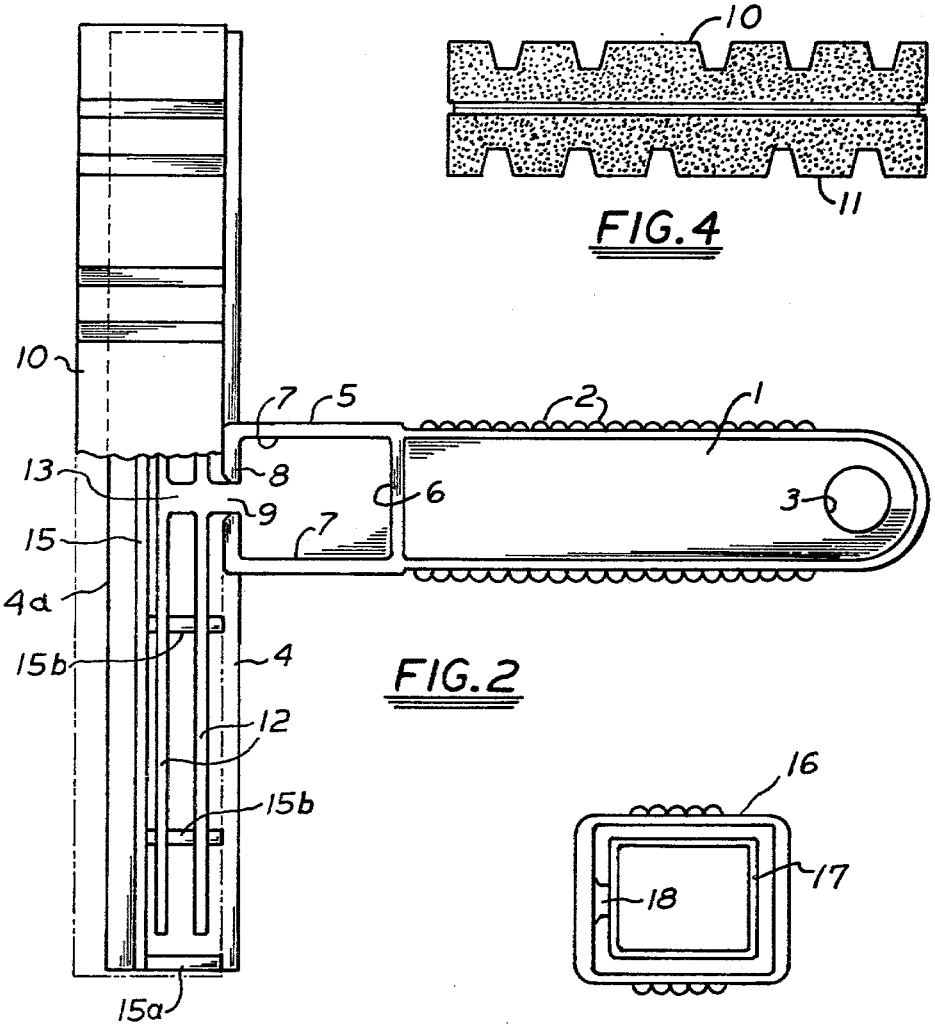
FIG. 2
FIG. 3

CLEANING DEVICE

BACKGROUND OF THE INVENTION AND PRIOR ART

It is an essential consideration of the invention to have in mind that cleaning and drying of particularly configured surfaces such as those which are formed by the piano keyboard and specifically the black and white keys thereon, since cleaning and drying of such surfaces are found to be particularly time taking and a nuisance where nothing has heretofore been provided of pratical nature to effect such cleaning and drying.

The only attempt known of providing such a device, is that shown in the Simmons Pat. No. 676,966, wherein there is disclosed a device having a felt material adapted to configure to an octave of keys black and white, on a piano, but made of felt and not being designed other than to use that particular section for the cleaning of the keys. There is no contemplation in this device of applying a cleaning material, and effecting the cleaning and drying with the device as it is configured and in a single device for the purpose, the broad contemplation of the invention herein under consideration.

As a matter of fact, the concept hereof is to provide a simple plastic device preferably formed of an integral nature and in flat configuration generally speaking so as to provide a handle portion, and a part thereof integral therewith which will support plastic foam material of different kinds so as to in turn furnish a cleaning material such as a soap or the like to one of the plastic elements, which in turn configures to the keys of an octave of a piano and after cleaning material is applied thereto, manipulation of the handle will present to the keys in this same area and same configuration a plastic material which will in turn dry the keys and thus effect an operation which is particularly annoying under some circumstances.

The device is arranged to extend to the inner most recesses of the keys since there is nothing to interfere therewith, and includes its own container to supply a liquid cleaning material or the like, with suitable provisions for directing the cleaning material to the sponge and thereby ultimately to the keys which are desired to be cleaned by this application and subsequent manipulation as heretofore outlined.

With the foregoing in mind it will be clearly apparent that the principal object of the invention is to provide a simple device, adapted to effect a cleaning operation which is usually time taking and not particularly effectively performed, since the article hereof includes means to supply a cleaning material, direct the same to a suitable plastic sponge like element which in turn delivers it to the place being cleaned whatever the conformation thereof, and manipulation thereafter providing and presenting a similarly configured surface to effect the drying desired after the cleaning heretofore effected.

Other and further objects of the invention will be understood from a consideration of the specification appended hereto and disclosed in the drawing wherein:

FIG. 1 is a sectional view showing the article hereof and particularly indicating the form of the device so as to disclose its relatively simple configuration, indicating the container provided integrally therewith and the mounting of the respective cleaning and drying element and instrumentalities with the cap for the container positioned in alignment with the container so as to cover the same when suitably manipulated therefore.

FIG. 2 is a top plan view, partly in section to further illustrate the configuration of the device.

FIG. 3 is a bottom view of the cap or closure for the container section of the device.

FIG. 4 is an end view taken from the left hand end of FIG. 1 so as to indicate the configuration of the cleaning element and drying instrumentality as configured from the foam material selected.

DESCRIPTION OF THE INVENTION

Referring to FIG. 1, the invention hereof resides in the provision of a handle designated 1 of generally flat configuration elongated so as to provide for gripping by the hand, suitable gripping elements such as 2 being formed at opposite edges thereof, and an opening at 3 being furnished for hanging the device in any particular place or otherwise carrying the same as may be desired.

The handle 1 is preferably of plastic and formed integrally therewith is a support means which is in the form of a flat element 4, and at the juncture of the handle 1 and support means 4, is provided a container section 5 generally rectilinear in plan as seen in FIG. 2.

The container 5 includes the upright sides such as 6 at the rear and 7 at opposite sides thereof with a forward portion 8 in which an opening 9 is provided and to be closed in a manner subsequently to be described.

Positioned ahead of the container on the flat support means 4 which will be designated as an elongated flat member, are the respective foam cleaning element 10 and the drying instrumentalities 11 being substantially identical as seen in FIG. 4, with the same arranged however to follow the same contour when the handle 1 is manipulated to reverse the positions of the respective foam parts 10 and 11. In this instance the parts are shown arranged to conform to the black and white keys of the piano the depressed surfaces obviously conforming to the black keys and the flat extremities to the white keys in a manner which will be apparent.

The parts 10 and 11 are proportioned so that the widths denoted A and B respectively are substantially greater than that of the flat element 4, whereby the beveled edge **4*a* thereof will normally be in recessed condition as shown in FIG. 1, but may be used for any appropriate purpose, to scrape for example, by suitable application of pressure exerted through the handle 1, to compress the foam parts 10 and 11** sufficiently therefore.

Suitably formed in the upper surface of the member 4, are grooves 12, which lead to the central portion and in turn are connected by a passage 13 to the interior of the container 5 previously described in detail.

The grooves are relatively shallow in the upper surface of the member 4, and adapted to deliver to the lower portion of the foam element 10 a liquid cleaning material from the container 5.

The element 10 is positioned on the surface of the member 4 so as to assume the somewhat rearwardly inclined attitude as suggested in FIG. 1 being fastened at 14 at its inner part, and at its outer edge being supported on a ridge 15 which extends along the surface of the member 4 so as to cause the element 10 to be maintained in the position disclosed in normal conditions and particularly to prevent the dripping and other undesired passing of liquid cleaner or the like over and beyond the ridge 15 so that it might come into contact or pass to the lower drying instrumentalities of the foam and designated 11.

Near each end of the passages 12, suitable formations 15*a* are provided to prevent spilling of cleaning liquid from the ends, and at intermediate points glue posts 15*b* are positioned to provide additional areas of adhesion for the foam element 10, such areas extending to at least the plane of the lower surface of such element.

In other words this is arranged to prevent the cleaning material from passing inadvertently to the drying instrumentalities.

The cap or closure 16 for the container 5 includes a flat portion 16*a* and a suitable lip 17 to extend within the sides 6 and 7. However at the forward part, the gate 18 is provided which conforms to the opening in the wall 8 as will be seen in plan in FIG. 2.

FIG. 3 discloses the form of the gate 18 as conforming to the opening in the wall 8 previously mentioned.

Thus when a suitable liquid cleaning material is deposited in the container 5, and the cap 16 applied thereto, the only escape of a liquid will be underneath the lower edge of the gate 18 and this is calculated so as to provide a very small opening and thereby minimize the escape of fluid except as may be demanded by the foam cleaning element 10 and may be absorbed and delivered thereby in the cleaning operation.

It is noted that the cleaning element 10 is desirably formed of a foam polyester, of light density, preferably on the order of 2 lbs. plus or minus per cubic foot, and of a porosity which is designated by cell size of 40 to 50 cells per lineal inch.

It has been found that these specifications, provide particularly good qualities in the cleaning element and are effective in carrying out the desired end hereof.

At the same time, the foam material of which the drying instrumentalities are comprised, is a polyurethane foam having the hydrophilic properties desired, and of a pore size on the order of 100 pores per lineal inch, this foam being capable of absorbing 30 times its own weight in water, indicating its drying capacity.

The use of the article will be understood by suggesting that manipulation of the same back and forth over the piano keys from front to rear, in the configuration shown, with one or the other of the parts 10 or 11 in contact with the surfaces of the keys between the black and white keys thereof, by simply reversing the respective positions to effect the cleaning and drying operations.

Furthermore the widths A and B are such that they will entirely cover the outer ends of the white keys for example by turning the handle at 90 degrees with respect to a particular key and moving the foam part 10 or 11 in and out thereon.

While the foregoing has been described as related to piano or other keyboard instrument cleaning, it is apparent that other objects may be cleaned where suitable conformations are incorporated in such foam parts and manipulation is appropriate manner is effected, to apply a cleaning liquid and subsequently dry the area to which it was applied.

It is also to be understood that conformations of these foam elements and instrumentalities are such as to clean and dry other similar sorts of devices as piano keys, or adding machine keys or the like under certain circumstances as will be clear to those observing the concept herein.

Since the device as a whole is of integral nature, it may be readily molded in plastic and effective to carry out its intended purpose as heretofore described with minimum cost.

I claim:

1. A cleaning device comprising a handle, support means for mounting of a cleaning element and drying instrumentalities connected thereto, a container mounted on the handle, and means to supply cleaning material to the support means, a cleaning element at one side of the support means to receive such cleaning material and drying instrumentalities on the opposite side of said support means, the support means including passage means to supply the cleaning material to the cleaning element, the passage means being in turn connected to the container, the support means further comprising an elongated, flat member having at least one groove extending along one surface thereof, a connection extends from said groove to the container, and the container includes a cover with a gate, said gate to control the flow of the cleaning material to the groove through said connection, the cleaning element being connected at one side of the flat member, and the cleaning material is supplied to the cleaning element near its connection to the one side aforesaid.

2. A device as claimed in claim 1, wherein the cleaning element is comprised of a foam material having 40–50 pores to the lineal inch arranged to distribute the cleaning material throughout the cleaning element, the drying instrumentalities are comprised of a foam material having substantially smaller pores and of more absorbent composition, connected to the opposite side of the member.

3. The combination as claimed in claim 2, wherein the cleaning and drying instrumentalities are of substantially identical shape and dimensions, to alternately cover substantially the same areas in use.

4. A device as claimed in claim 1, wherein the support means and handle, are of one unitary piece construction, the container is integral and one piece with the handle at one side thereof, the means of supply cleaning material extends from the container and along the corresponding side of the flat member, and the cleaning element and drying instrumentalities are of plastic foam material, the element being fastened to the said one side, and the instrumentalities to the opposite side of the member aforesaid.

5. A device as claimed in claim 1, wherein the support means comprises an elongated flat member integral and one piece with the handle, the container is integral with the handle at one side thereof, the means to supply cleaning material extends from the container and along the corresponding side of the flat member, and the cleaning element and drying instrumentalities are of plastic foam material, the element being fastened to the said one side, and the instrumentalities to the opposite side of the member aforesaid, said element and instrumentalities being of substantially identical configuration.

* * * * *